US006687956B1

(12) United States Patent
Foo

(10) Patent No.: US 6,687,956 B1
(45) Date of Patent: Feb. 10, 2004

(54) HINGE AND METHOD

(75) Inventor: Chik Hee Foo, Singapore (SG)

(73) Assignee: ISS Mart Pte., Ltd., Singapore (SG)

( * ) Notice: Subject to any disclaimer, the term of this patent is extended or adjusted under 35 U.S.C. 154(b) by 0 days.

(21) Appl. No.: 09/622,819

(22) PCT Filed: Feb. 10, 1999

(86) PCT No.: PCT/SG99/00007

§ 371 (c)(1),
(2), (4) Date: Oct. 2, 2000

(87) PCT Pub. No.: WO99/43917

PCT Pub. Date: Sep. 2, 1999

(30) Foreign Application Priority Data

Feb. 27, 1998 (SG) ..... 9800452

(51) Int. Cl.[7] ..... E05D 1/06
(52) U.S. Cl. ..... 16/269
(58) Field of Search ..... 16/269, 267, 355, 16/225; 248/215

(56) References Cited

U.S. PATENT DOCUMENTS

| | | | | | |
|---|---|---|---|---|---|
| 3,484,895 | A | * | 12/1969 | Mock | 16/356 |
| 3,648,328 | A | * | 3/1972 | McCabe | 16/355 |
| 3,718,943 | A | * | 3/1973 | Bustin | 16/355 |
| 4,333,206 | A | * | 6/1982 | Lang et al. | 16/335 |
| 4,852,213 | A | * | 8/1989 | Shewchuk | 16/355 |
| 5,329,667 | A | * | 7/1994 | Erskine | 16/355 |
| 5,742,980 | A | * | 4/1998 | Nitta | 16/355 |
| 6,145,165 | A | * | 11/2000 | Torcato | 16/355 |

FOREIGN PATENT DOCUMENTS

| | | | | |
|---|---|---|---|---|
| CH | 562949 A | | 6/1975 | |
| EP | 637006 | * | 2/1995 | G09F/15/00 |
| GB | 1508122 A | | 4/1978 | |
| GB | 2062745 | * | 5/1981 | G09F/13/04 |
| GB | 2076884 A | | 12/1981 | |
| GB | 2114351 | * | 8/1983 | G90F/15/00 |

* cited by examiner

*Primary Examiner*—Anthony Knight
*Assistant Examiner*—Doug Hutton
(74) *Attorney, Agent, or Firm*—Welsh & Katz, Ltd.

(57) ABSTRACT

A hinge is provided which has a retaining member (40) and a hook member 90. The retaining member is attached to a first component and the hook member is attached to a second component to form a hinge joint. The hinge is able to provide a great degree of freedom of movement for the components because of the use of a hook member in the hinge. The hook member acts as a pivot point, while the retaining member prevents the hook member from being pulled away from the retaining member either laterally or transversely.

19 Claims, 10 Drawing Sheets

HINGE AND METHOD

FIELD OF INVENTION

The present invention relates to a hinge, and to a display system incorporating such a hinge. The invention also relates to a method of creating a display system incorporating such a hinge.

PRIOR ART

Display systems, such as sign boxes or display cabinets, for example, are used to display information to the public. Typically, the information may consist of printed matter, posters, articles, notices, display items and objects and the like. These systems usually include a cabinet in which the information is placed. The cabinet is provided with at least one panel consisting of a transparent material, such as glass or perspex, which enables the encased information within the cabinet to be viewed from without, while protecting the information from the atmospheric elements and/or from unauthorised tampering. In order to insert and replace the information in the display system, the panel with the transparent material is moveable in order to provide access to the interior of the display cabinet.

In an earlier United Kingdom Patent No. 2,280,532 (Kim Huat Teo), the moveable panel with the transparent material is provided with hinges designed according to a ball and socket mechanism. In U.K. Patent No. 2,280,532 the ball is substantially surrounded by the socket portion (referred to in the Teo patent as the "bead" and "groove"). This provides an advantage that the ball cannot disconnect from the socket, such that the panel with the transparent material cannot pull away from its hinge. However, this advantage carries with it an associated disadvantage, because the surrounding socket limits the rotational movement of the ball within the socket. For example, in the embodiment illustrated in U.K. Patent No. 2,280,532, the moveable panel is only able to swing open up to maximum of around 45° to 50° or thereabouts.

In another earlier United Kingdom Patent No. 2,062,745 (Cattermole et. al.), a male element, having part of its surface formed as a curve, is pivotally located within a shallow female socket. The female socket also has part of its surface formed as a curve. The respective curved parts approximate the pivotal mechanism of a ball and socket mechanism by sliding against each other. However, the male element is able to be pull out from the female socket because the female socket does not substantially surround the male element, as would be the case in the true ball and socket mechanism. Similarly, in U.K. Patent No. 2,114,351 (Radin), the moveable panel is able to pull away from the main cabinet because, in the Radin patent, the curved portion of the male element is not substantially encircled by the curved female socket portion. Thus, in both the Cattermole and Radin patents, the advantage of the moveable panel being able to swing out and pivot to about ninety degrees, comes with the associated disadvantage that the panel may be pulled away from the cabinet. In the hinges used in the Radin and Cattermole patents, any attempts to more securely enclose the male element within the female socket portion would result in a reduction of the angle of rotation of the moveable panel member.

An object of the present invention is to overcome or substantially ameliorate at least some of the disadvantages of the prior art. Hence, it is not required that the invention, in its broadest aspect, should address each and every one of the problems mentioned above, but at least some of the problems.

SUMMARY OF INVENTION

According to the present invention, there is provided a hinge for connecting a first and second component, the hinge having an axis of rotation and including:

a retaining member and a hook member;

the retaining member being attachable to the first component and the hook member being attachable to the second component such that, in use, the first and second components are connected by the hinge whereby the second component is rotatable relative to the first component through a predetermined angle of movement about the axis of rotation of the hinge, the hook member cooperating with the retaining member such that, in use, the retaining member prevents the hook member from being separated from the retaining member by inhibiting movement of the hook member laterally relative to the axis of rotation throughout the complete predetermined angle of movement of the second component relative to the first component about the axis of rotation, the hook member having a stem and a hooking portion which includes a lip that projects inwardly from the end of the hooking portion back towards the stem, The lip being operatively adapted to minimize movement of the hook member with respect to the retaining member generally in said lateral direction.

According to another aspect of the present invention, there is provided a hinge for connecting a first and second component, the hinge having an axis of rotation and including:

a retaining member and a hook member;

wherein the hook member cooperates with the retaining member such that, in use, the hook member is rotatable relative to the retaining member through a predetermined angle of movement about the axis of rotation of the hinge;

whereby the retaining member prevents the hook member from being separated from the retaining member by inhibiting movement of the hook member laterally relative to the axis of rotation throughout the complete predetermined angle of movement of the hook member relative to the retaining member about the axis of rotation, the hook member having a stem and a hooking portion which includes a lip that projects inwardly from the end of the hooking portion back towards the stem, The lip being operatively adapted to minimize movement of the hook member with respect to the retaining member generally in said lateral direction.

the retaining member being attachable to a first component and the hook member being attachable to a second component such that the first and second components are connected by the hinge.

The lip may minimize movement of the hook member with respect to the retaining member within at least a part of the complete predetermined angle of movement.

The lip may minimize movement of the hook member with respect to the retaining member within at least a part of the complete predetermined angle of movement.

The retaining member may inhibit movement of the hook member in a direction that is generally perpendicular to the axis of rotation.

Preferably, the hook member is engageable with said retaining member by being hooked to the retaining member.

Preferably, when said hinge is assembled, the hook member cannot be disengaged from the retaining member.

Preferably, the hooking portion is curved and connected to the stem, said retaining member defining a cavity with an opening, the cavity being of sufficient size to entrap said hooking portion therein, and the opening being of sufficient size to allow said stem to pass therethrough but the opening not being sufficient in size to allow said hooking portion to pass therethrough.

The hook member may be able to move about the retaining member through an angle of around ninety degrees.

Preferably, retaining member and said hook member are formed by extrusion.

According to a further aspect of the present invention, there is provided a display cabinet having an enclosure adapted to contain display information, and a cover having a transparent panel, wherein said cover is engageable with said enclosure by a hinge as described above.

In the display cabinet, the enclosure may be formed orthogonally by four cabinet frame members separably joined by frame joints.

In the display cabinet, the cover may be formed orthogonally by four cover frame members separably joined by frame joints.

According to yet a further aspect of the invention, there is provided a method of hingedly connecting a first and second component, comprising the steps of:

attaching a retaining member to a first component;

attaching a hook member to a second component;

engaging said hook member with said retaining member to form a hinge that has an axis of rotation such that the second component is rotatable relative to the first component through a predetermined angle of movement about the axis of rotation of the hinge, the hook member cooperating with the retaining member such that, in use, the retaining member prevents the hook member from being separated from the retaining member by inhibiting movement of the hook member laterally relative to the axis of rotation throughout the complete predetermined angle of movement of the second component relative to the first component about the axis of rotation, the hook member having a stem and a hooking portion which includes a lip that projects inwardly from the end of the hooking portion back towards the stem, The method further including the step of using the lip to minimize movement of the hook member with respect to the retaining member generally in said lateral direction.

According to yet another aspect of the present invention, there is provided a kit of parts having components that are operatively adapted to be assembled together to form a display cabinet described above, the display cabinet having a hinge described above.

DRAWINGS

In order that the invention might be more fully understood, embodiments of the invention will be described, by way of example, with reference to the accompanying drawings, in which.

DESCRIPTION OF EMBODIMENT

Figure 1:
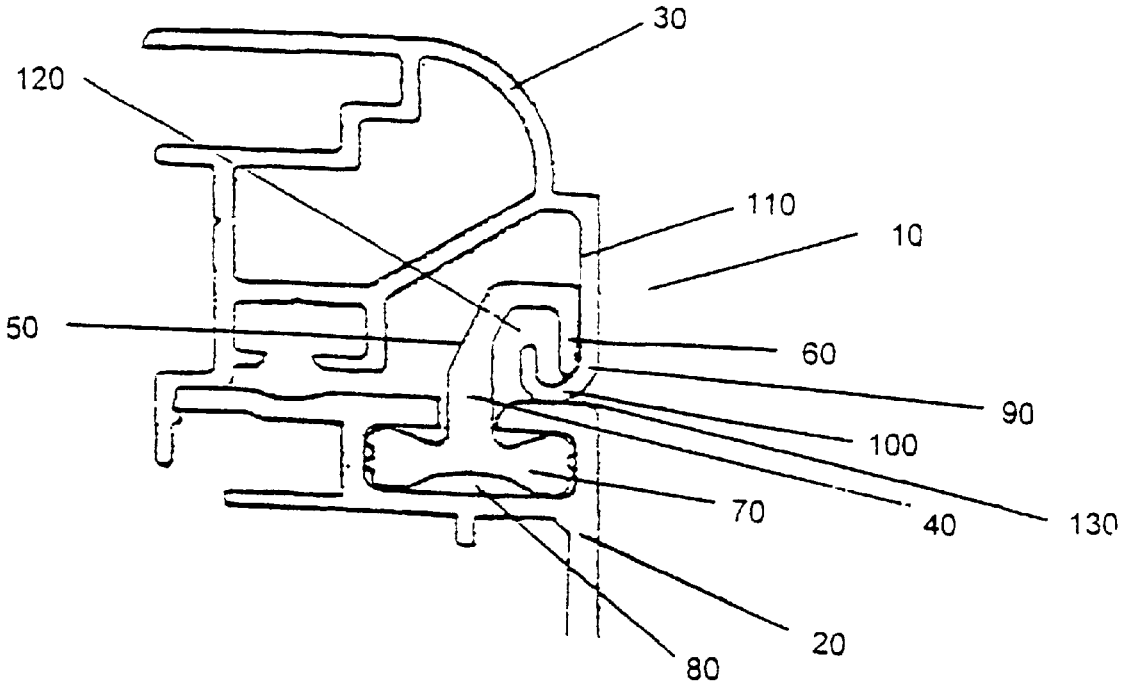
FIG. 1 illustrates a hinge constructed in accordance with an embodiment of the present invention.
Figure 1A:
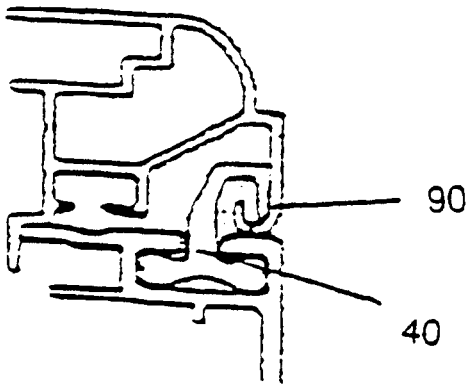
FIGS. 1A, 1B and 1C illustrate the movement of parts of the hinge of FIG. 1.
Figure 1B:
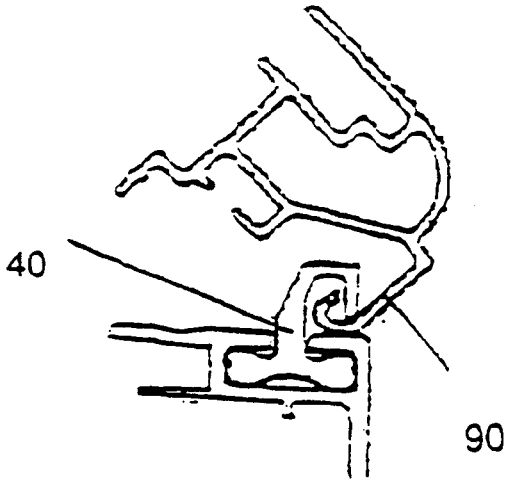
Figure 1C:
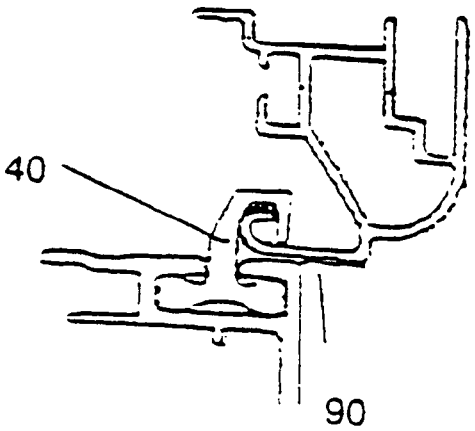

Referring to the accompanying drawings, FIG. 1 illustrates a first embodiment of a hinge 10. FIG. 1 is identical to FIG. 1A. The set of three drawings in FIGS. 1A, 1B and 1C illustrate the movement of the hinge.

The hinge 10 is intended to act as a hinge connection between a first component and a second component. In the embodiment, the first component is an enclosure 20 of a display cabinet, and the second component is a cover 30 for the cabinet.

In FIG. 1, the hinge 10 has a retaining member in the form of a groove member 40. The groove member 40 is provided with an upstanding stem 50, the end of which is provided with depending flange 60. The base 70 of the groove member 40 is anchored in a cavity 80 formed in the body of the first component.

A hook member, in the form of a hook flange 90 is arranged so as to be moveably engaged with the groove member 40. In the embodiment, the hook flange 90 consists of a curved hooking portion 100 and a hook stem 110. The hook flange 90 is engageable with the groove member 40 by virtue of the hooking portion 100 being able to be hooked to the depending flange 60 of the groove member 40.

The hooking portion 100 need not always be in direct contact with the flange 60. However, when the hinge 10 is assembled, the hook member cannot disengage from the retaining member. Specifically, the retaining member prevents the hook member from being pulled away from the retaining member either laterally or transversely. This can best be seen in the sequence shown in FIGS. 1A, 1B and 1C. In these figures, the hook flange 90 is able to move about the groove member 40 through an angle of around ninety degrees. In each position, shown in each Figure, the groove member 40 defines the boundary of permissible movement for the hook flange 90. Thus, the hook flange 90 is able to rotate with respect to the groove member 40, but cannot be pulled away from the groove member 40.

In FIG. 1, the groove member 40 defines a cavity 120 with an opening 130. (In FIG. 1, the curved hooking portion 100 is positioned in the opening 130). The cavity 120 is of sufficient size to entrap the curved hooking portion 100 inside the cavity, and the opening 130 is of sufficient size to allow the hook stem 110 to pass therethrough. However, the opening 130 is not sufficient in size to allow the entire hooking portion 100 to pass through the opening 130. Thus, this hooking mechanism allows the hook member to move about the retaining member, while the retaining member prevents the hook member from disengaging.

This hooking mechanism is distinct from other kinds of connection mechanisms, such as ball and socket-like joints.

An advantage of such a hooking mechanism is that the hook member has the greatest degree of freedom to move about the retaining member, as compared, say, to a ball and socket-like mechanism in which the degree of rotation is limited by the opening of the socket. Thus, the present embodiment has a distinct advantage over ball and socket-like mechanisms, because the components of the present embodiment have a greater degree of movement, but still maintain the advantage of the components being inseparable, at least after the hinge is assembled.

In the embodiment, the retaining member and the hook member are formed by extrusion, such that the retaining member and hook member are actually formed as part of an elongated structure in which the hook and retaining members are each incorporated in the cross-section of elongated structures. Thus, the attachment of the retaining member and hook member respectively to the first and second components may be achieved by the members being formed integrally with the components. In FIG. 1, the retaining member, in the form of the upstanding stem 50, is detachably attached to the component, whereas the hook member in the present embodiment is attached in the manner of being formed integrally with the component by extrusion.

In other embodiments, the hinge need not be manufactured by extrusion, and may consist of a single independent hinge.

Further Embodiment of Hinge

Figure 2:
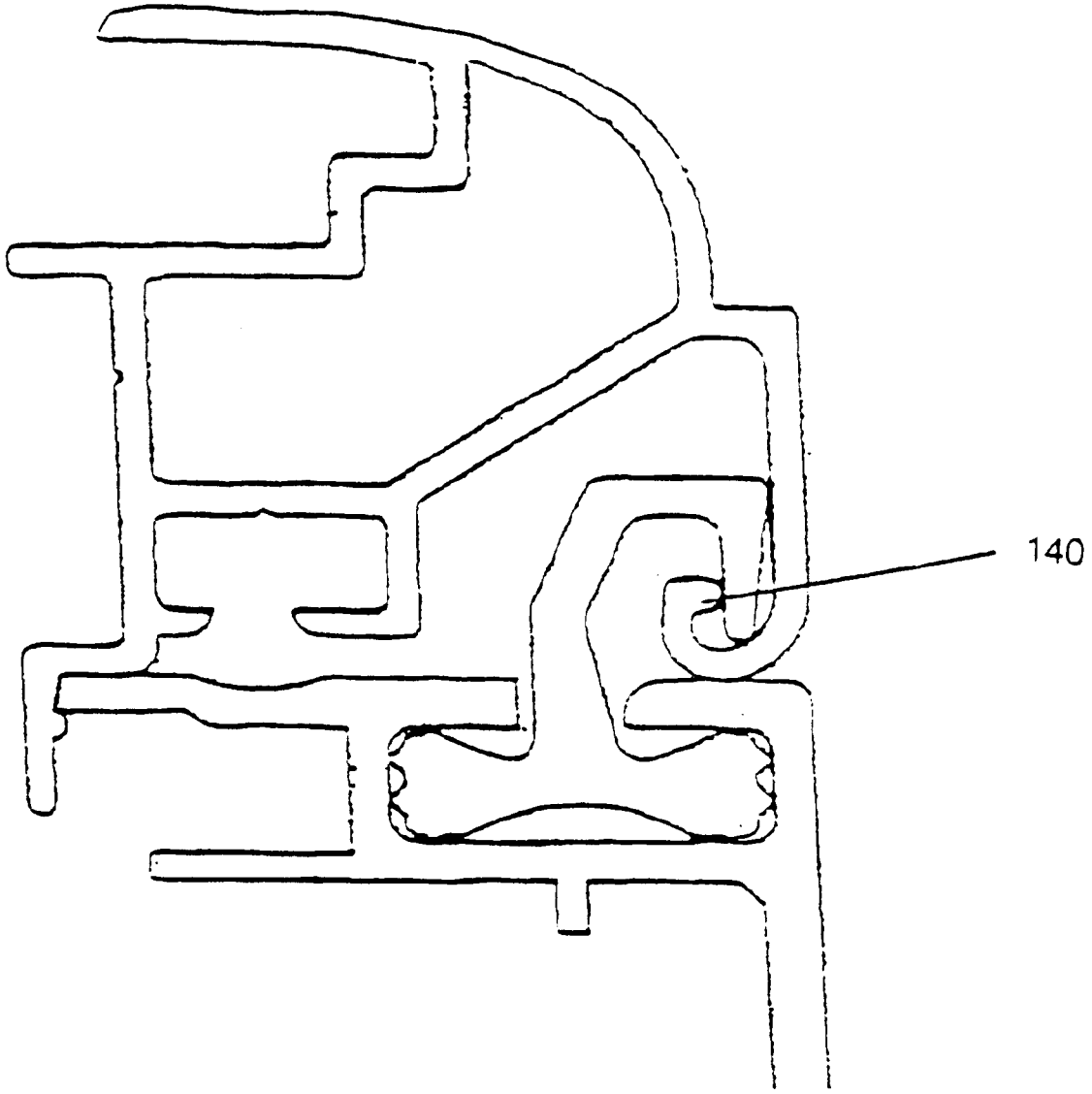
FIG. 2 illustrates a further embodiment of a hinge, which has been slightly modified over the embodiment shown in FIG. 1.
Figure 2A:
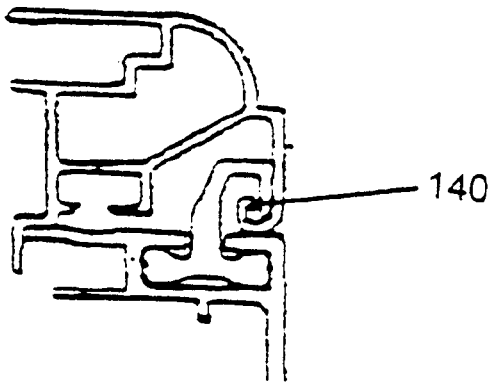
FIGS. 2A, 2B and 2C illustrate the movement of parts of the hinge of FIG. 2.
Figure 2B:
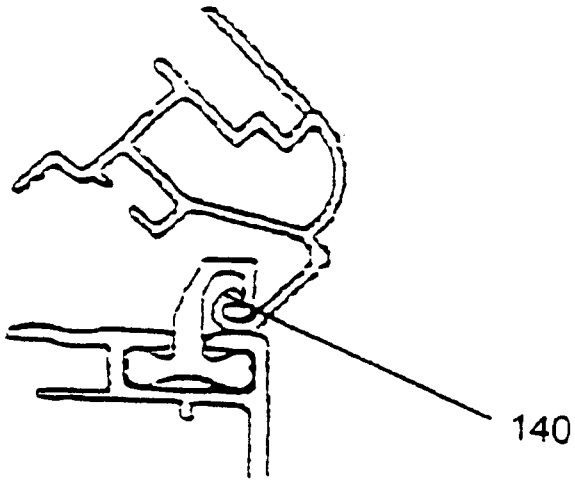
Figure 2C:
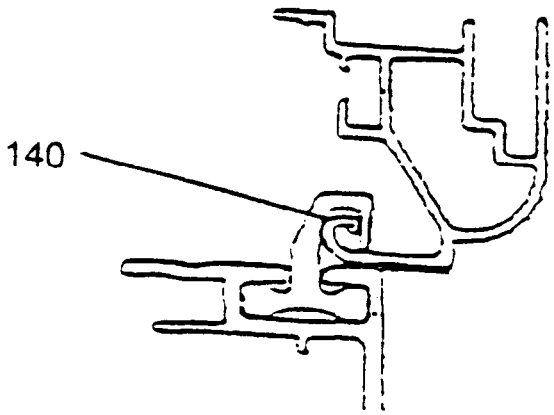

FIG. 2 illustrates a further embodiment of a hinge, which has been slightly modified over the embodiment shown in FIG. 1. In the hinge of FIG. 2, the end of the curved hooking portion is provided with an inwardly projecting lip 140 which projects inwardly and back towards the hook stem 110. The movement of this further hinge is illustrated sequentially in FIGS. 2A, 2B and 2C.

In the further embodiment, an advantage of having the projection lip 140 is that the lip minimizes the translation or side to side movement of the hook member in the cavity. For example, the embodiments of FIG. 1, there is a significant amount of leeway for the hook member to translate from right to left (as viewed in the diagram). This is because there is a significant gap between the end of the curved hooking portion 100 and the hook stem 110. Within this gap, the depending flange 60 is positioned. The depending flange 60 serves to prevent the hook member from being pulled away laterally, but there is leeway for the hook member to move laterally, from right to left. In comparison, in the embodiment in FIG. 2, the inwardly projecting lip 140 of the hinge of FIG. 2 narrows the gap between the end of the curved hooking portion 100 and the stem 110, the lateral movement of the hook member is minimized. Thus, in the embodiment in FIG. 2, there is less leeway for the hook member to move laterally from right to left, and this is achieved without sacrificing the rotational freedom of movement of the hinge components.

Display Cabinet

Figure 3A:
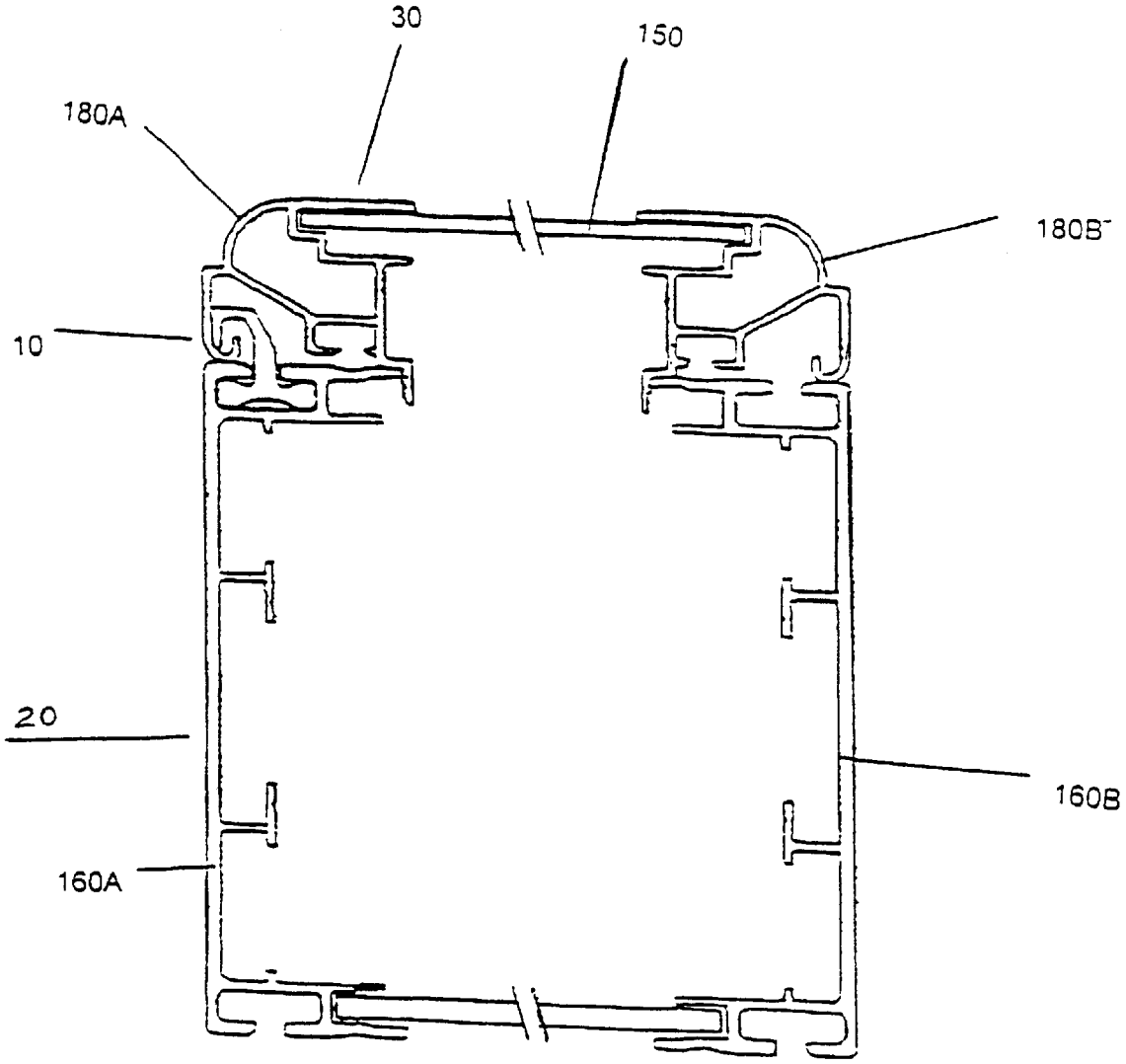
FIGS. 3A, 3B and 3C show a cross-section of a display cabinet which has a cover that is moveable because the cabinet is provided with the hinge shown in FIGS. 1, 1A, 1B and 1C. The sequence of FIGS. 3A to 3C shows the movement of the cover.
Figure 3B:
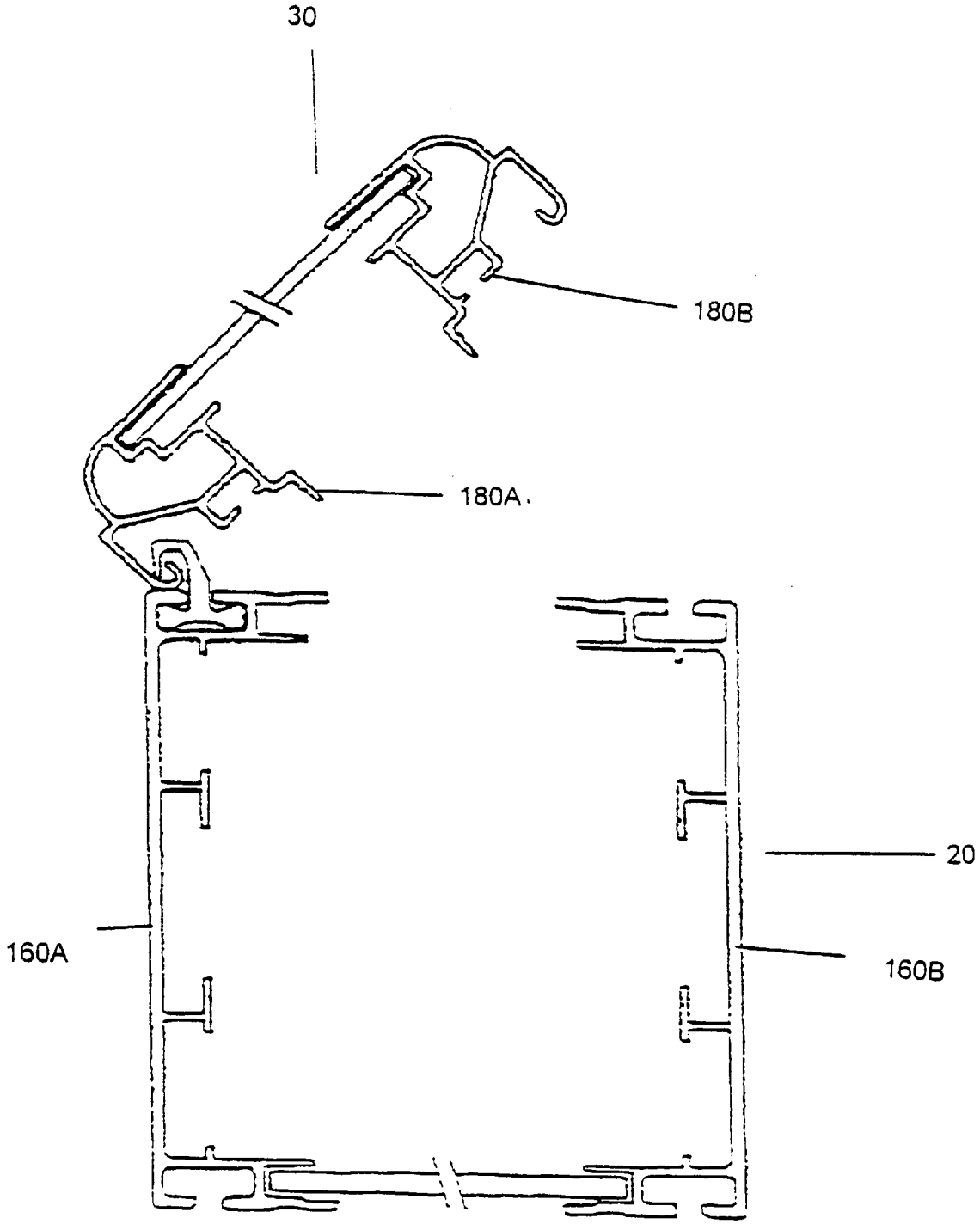
Figure 3C:
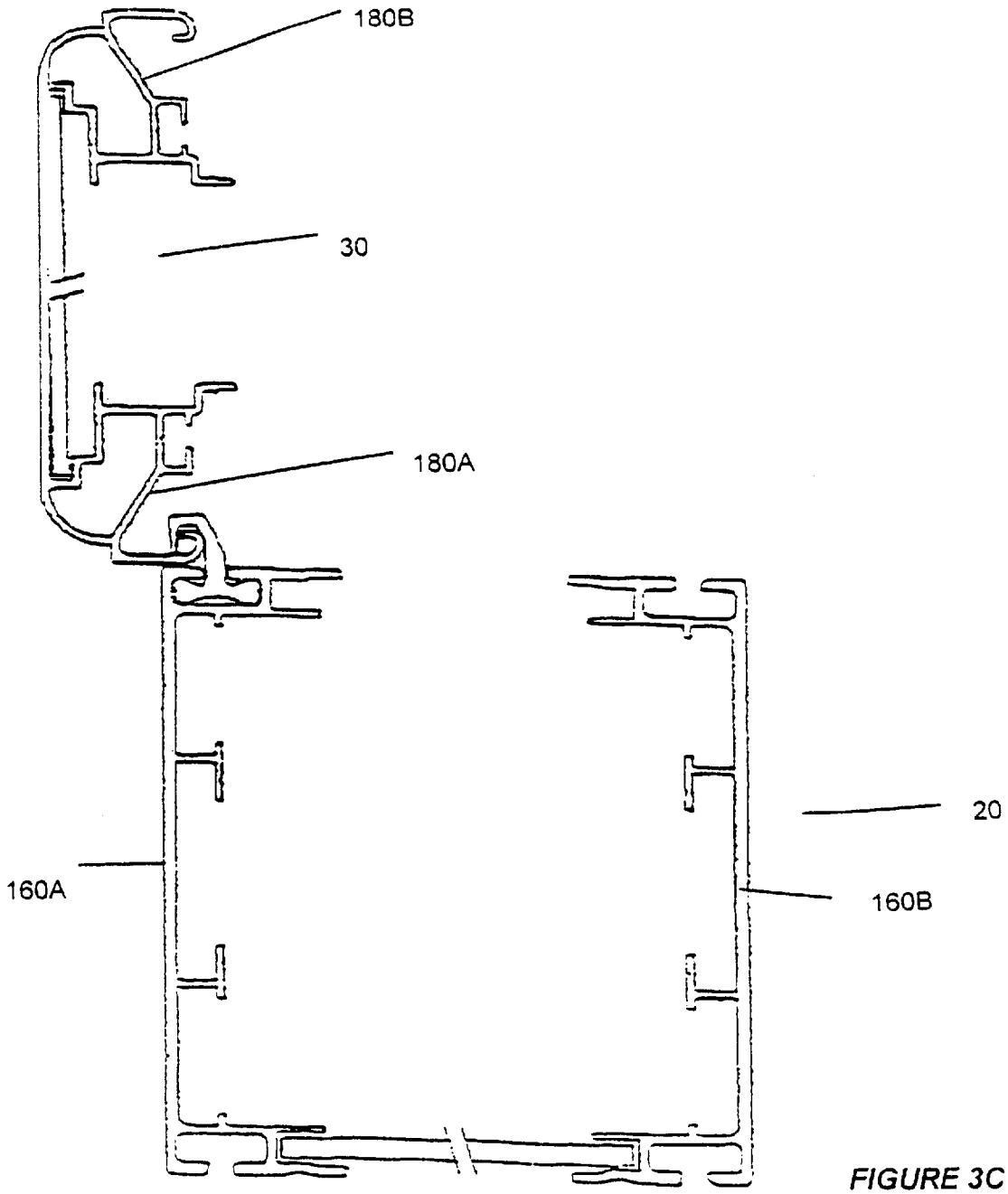

Hinges that are constructed in accordance with various embodiments of the present invention are used in display cabinets, amongst other applications. An embodiment of such a display cabinet is illustrated in FIGS. 3A, 3B and 3C, and in FIGS. 4 to 6. (FIGS. 3A to 3C illustrate the movement of the hinge, a similar manner to FIGS. 1A, 1B and 1C).

In FIG. 3A, a display cabinet consists of the enclosure 20 and the cover 30, mentioned earlier. The enclosure 20 of the display cabinet is adapted to contain display information, such as printed matter, posters, articles, notices, display items and objects and the like. Display information placed inside the enclosure 20 is protected from the atmospheric elements of wind and rain by the cover 30. The cover 30 has a transparent panel 150 so that the display information is visible through the panel 150. The cover 30 is engaged to the enclosure 20 by the hinge 10. The hinge used in the cabinet is based on the embodiments of the hinge of the present invention.

Figure 4:
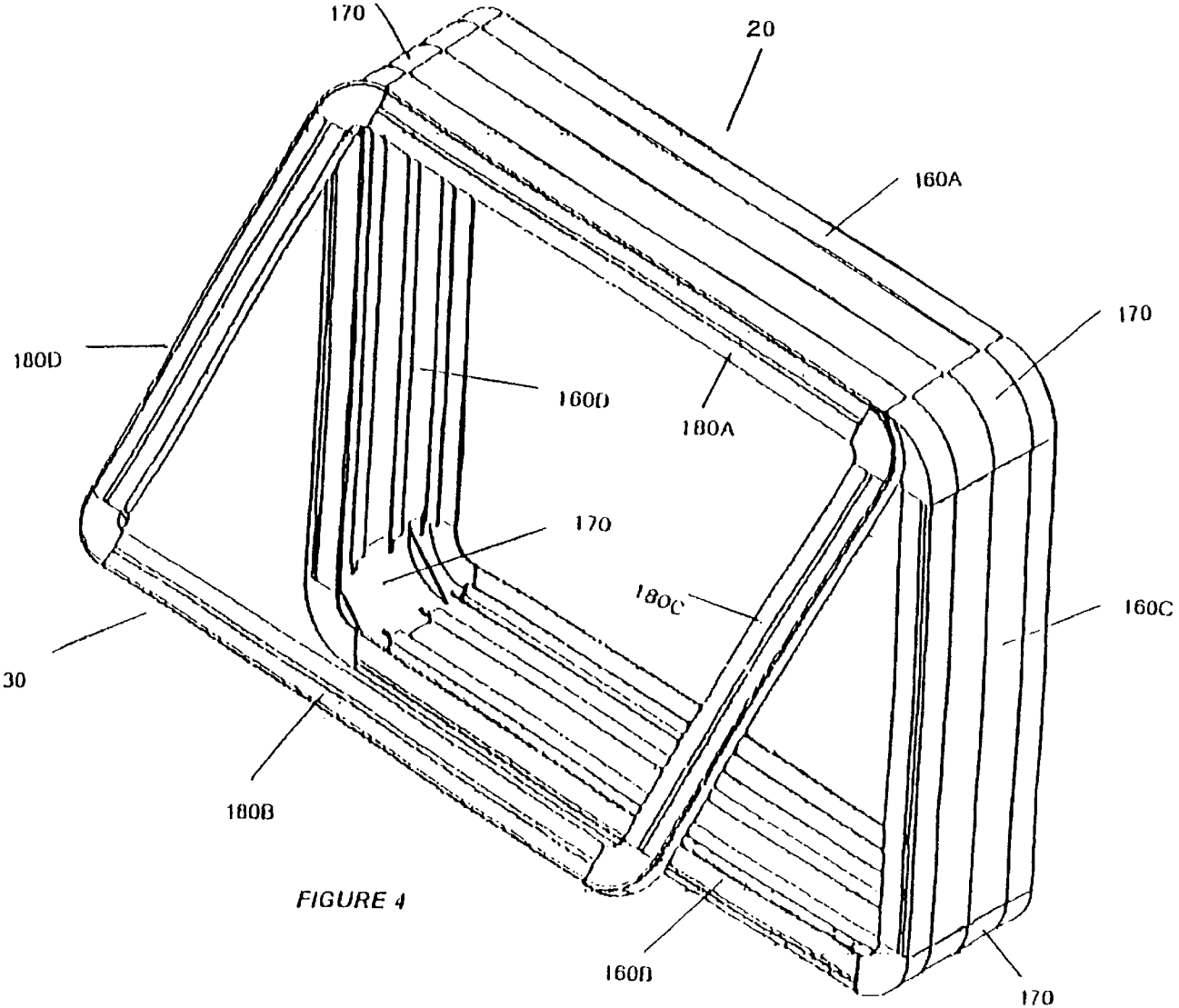
FIG. 4 is a perspective view of the display cabinet of FIGS. 3A, 3B and 3C.
Figure 5:
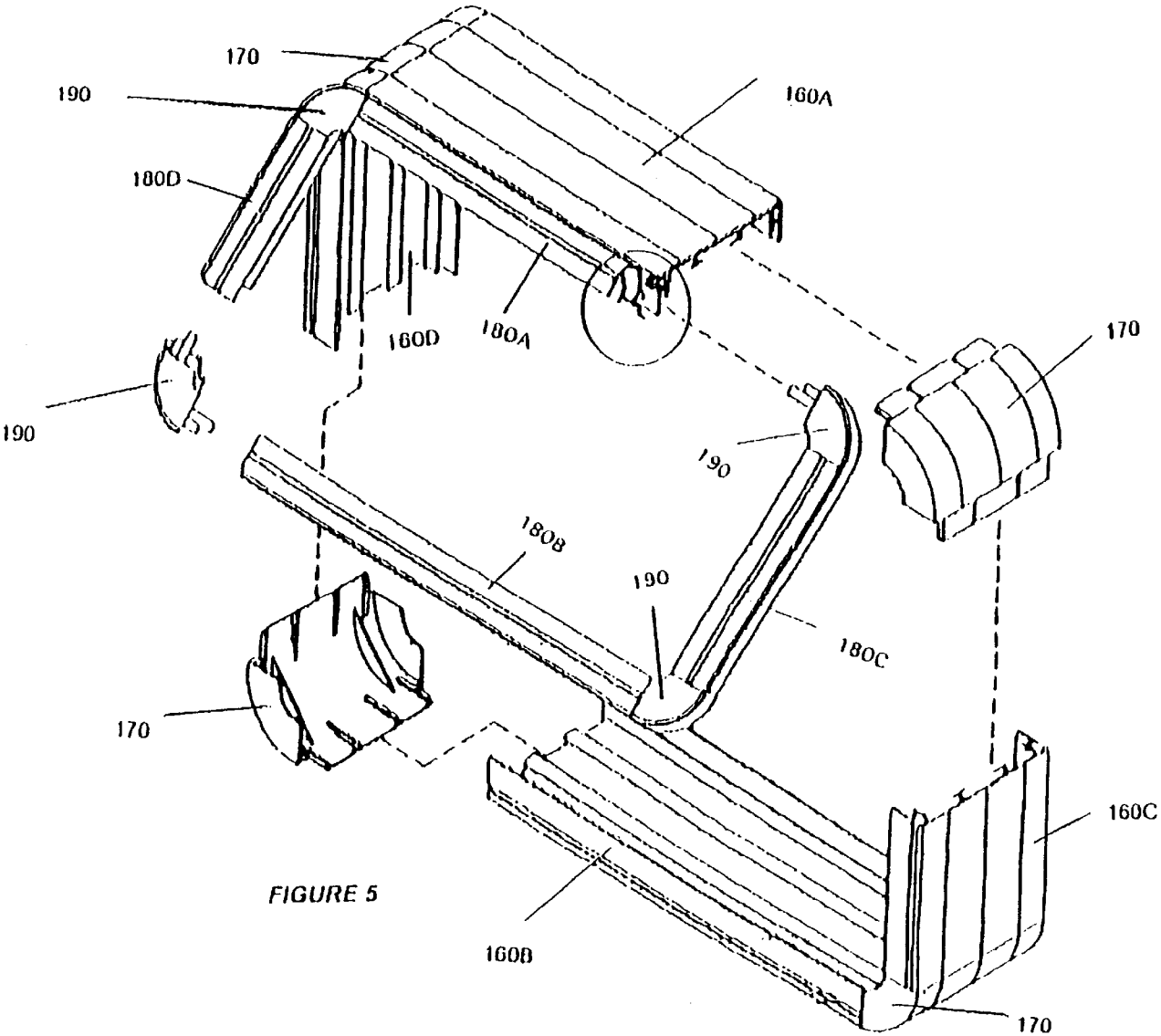
FIG. 5 is an exploded perspective view of the display cabinet of FIG. 4.

In the embodiment of a display cabinet, as best seen in FIGS. 4 and 5, the enclosure 20 is formed orthogonally by four cabinet frame members 160A, 160B, 160C, 160D separably joined together by frame joints 170. The cabinet frame members consist of two horizontal frame members 160A, 160B and two vertical frame members 160C, 160D. The pair of horizontal frame members is joined to the pair of vertical frame members at the edges of each frame member, through the use of frame joints 170, to form the orthogonal cabinet frame which defines the enclosure 20.

The cover 30 is also formed orthogonally by four cover frame members 180A, 180B, 180C, 180D separably joined by cover frame joints 190. The frame members consist of two horizontal frame members 180A, 180B and two vertical frame members 180C, 180D. The pair of horizontal cover frame members is joined to the pair of vertical cover frame members at the edges of each cover frame member, through the use of cover frame joints 190 to form an orthogonal cover frame.

Figure 6:
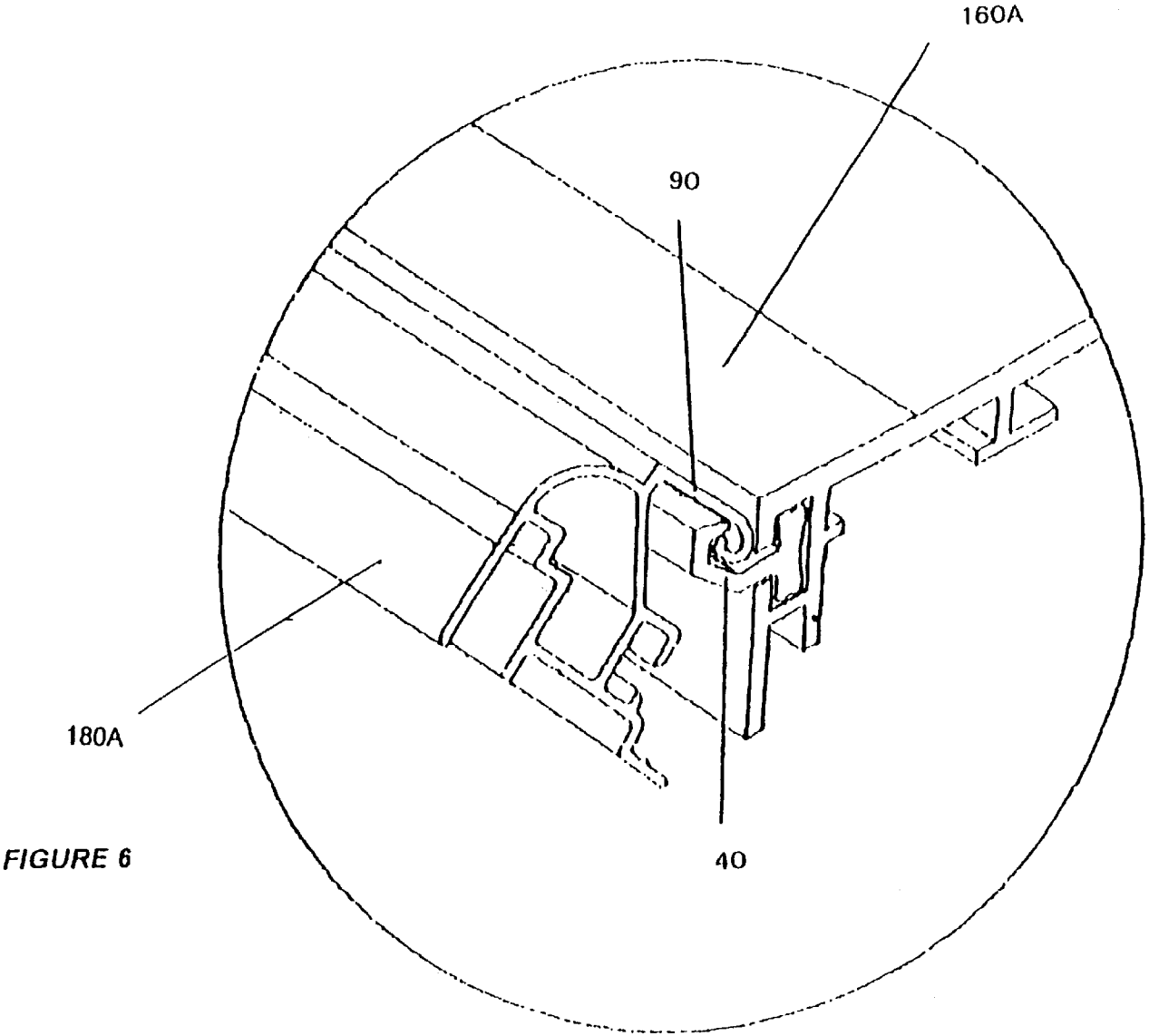
FIG. 6 is a sectional view of a portion of the display cabinet of FIGS. 4 and 5, shown in perspective view, in order to illustrate the presence of the hinge. The portion illustrated in FIG. 6 is an enlargement of a portion that has been circled in FIG. 5.

FIG. 6 is an enlargement of the portion in FIG. 5 that has been circled. FIG. 6 shows that the enclosure 20 (constructed from members 160 A–D) is pivotally engaged to the cover 30 (constructed from members 180 A–D) by the hinge 10 described above. Thus, due to the characteristics of the hinge described above, the cover 30 is able to pivot about the enclosure 20 through an angle of around ninety degrees, without the disadvantage of the cover disengaging from the enclosure during use. If the cover must be removed, the entire set of cabinet frame members must be disassembled.

(The hinge illustrated in FIG. 6 is the embodiment found in FIG. 2. Therefore, the precise details of the hinge should be ascertained from FIG. 2 and the supporting description.)

The dimensions and lengths of the various components, for example, the frame members and frame joints may be modified to create display cabinets of a wide range of sizes.

Although the hinge has been described in the context of a display cabinet, it is conceivable that hinges of the present invention may be used in other applications that require a large degree of rotation of the components connected by a hinge.

The components of the display cabinet may, in some cases, be provided as a kit of parts so that a user may assemble the cabinet. The steps of the method of assembling the kit of parts to form the hinged display cabinet require the user to assemble the various components.

The embodiments have been advanced by way of example only, and modifications are possible within the spirit and scope of the invention as defined by the appended claims.

What is claimed is:

1. A hinge for connecting a first and second component, the hinge having an axis of rotation and including:

a retaining member and a hook member;

wherein the hook member cooperating with the retaining member to form cooperating elements, such that, in use, the hook member is rotatable relative to the retaining member through a predetermined angle of movement about the axis of rotation of the hinge;

the hook member being in the shape of a J and having a stem and hooking portion which includes a lip that projects inwardly from an end of a hooking portion back towards the stem, the retaining member being in the shape of a J with a hook portion and a straight stem portion, the lip being operatively adapted to minimize movement of the hook member with respect to the retaining member generally in said lateral direction, the retaining member being attachable to the first component and the hook member being attachable to the second component such that the first and second components are connected by the hinge;

thehook member, defining a curvilinear portion, being substantially in constant contact with the first component as the second component rotates about the hinged axis, such that the cooperating elements of the hook member and the retaining member are isolated from the environment exterior to the first and second component.

2. A hinge for connecting a first and second component, the hinge having an axis of rotation and including:

a retaining member and a hook member;

each of said retaining member and said hook member being in the form of a J;

the retaining member being attachable to the first component and the hook member being attachable to the second component such that, in use, the first and second components are connected by the hinge whereby the second component is rotatable relative to the first component through a predetermined angle of movement about the axis of rotation of the hinge;

the hook member cooperating with the retaining member to form cooperating elements, such that, in use, the retaining member prevents the hook member from being separated from the retaining member by inhibiting movement of the hook member laterally relative to the axis of rotation throughout the complete predetermined angle of movement of the second component relative to the first component about the axis of rotation;

the hook member, defining a curvilinear portion, being substantially in constant contact with the first component as the second component rotates about the hinged axis, such that the cooperating elements of the hook member and the retaining member are isolated from the environment exterior to the first and second component;

the hook member having a stem and a hooking portion which includes a lip that projects inwardly from an end of the hooking portion back towards the stem;

the lip being operatively adapted to minimize movement of the hook member with respect to the retaining member generally in said lateral direction.

3. A hinge according to claim 2 wherein the lip minimizes movement of the hook member with respect to the retaining member within at least a part of the complete predetermined angle of movement.

4. A hinge according to claim 3 wherein the lip minimizes movement of the hook member with respect to the retaining member generally within the part of the complete predetermined angle of movement that is in the direction in which the lip projects.

5. A hinge according to claim 2 wherein the retaining member inhibits movement of the hook member in a direction that is generally perpendicular to the axis of rotation.

6. A hinge according to claim 2 wherein said hook member is engageable with said retaining member by being hooked to the retaining member.

7. A hinge according to claim 2 wherein, when said hinge is assembled, the hook member cannot be disengaged from the retaining member.

8. A hinge according to claim 2 wherein the hooking portion is curved and connected to the stem, said retaining member defining a cavity with an opening, the cavity being of sufficient size to entrap said hooking portion therein, and the opening being of sufficient size to allow said lip to pass therethrough but the opening not being sufficient in size to allow said hooking portion to pass therethrough.

9. A hinge according to claim 2 wherein said hook member is able to move about the retaining member through an angle of around ninety degrees.

10. A hinge according to claim 2 wherein said retaining member and said hook member are formed by extrusion.

11. A display cabinet having an enclosure adapted to contain display information, and a cover having a transparent panel, wherein said cover is engageable with said enclosure by a hinge according to claim 2.

12. A display cabinet according to claim 11 wherein said enclosure is formed orthogonally by four cabinet frame members separably joined by frame joints.

13. A display cabinet according to claim 11 wherein said cover is formed orthogonally by four cover frame members separably joined by frame joints.

14. A method of hingedly connecting a first and second component, comprising the steps of:

attaching a retaining member to a first component;

attaching a hook member to a second component;

engaging said hook member with said retaining member to form a hinge that has an axis of rotation such that the second component is rotatable relative to the first component through a predetermined angle of movement about the axis of rotation of the hinge;

the hook member cooperating with the retaining member to form cooperating elements, such that, in use, the retaining member prevents the hook member from being separated from the retaining member by inhibiting movement of the hook member laterally relative to the axis of rotation throughout the complete predetermined angle of movement of the second component relative to the first component about the axis of rotation, the hook member being in the shape of a J and having a stem and a hooking portion which includes a lip that projects inwardly from the end of the hooking portion back towards the stem, the hooking portion further, defining a curvilinear portion, being substantially in constant contact with the first component as the second component rotates about the hinged axis, such that the cooperating elements of the hook member and the retaining member are isolated from the environment exterior to the first and second component;

the retaining member being in the shape of a J having a straight stem portion and a hooking portion;

the method further including the step of using the lip to minimize movement of the hook member with respect to the retaining member generally in said lateral direction.

15. A method according to claim 14 wherein said hook member engages said retaining member by being hooked to the retaining member.

16. A method according to claim 14 wherein, once assembled, the hook member cannot be disengaged from the retaining member.

17. A method according to claim 14 wherein the hooking portion is curved and connected to the stem, said retaining member defining a cavity with an opening, the cavity being of sufficient size to entrap said hooking portion therein, and the opening being of sufficient size to allow said stem to pass therethrough but not sufficient in size to allow said hooking portion to pass therethrough.

18. A method according to claim 14 wherein said hook member is able to move about the retaining member through an angle of around ninety degrees.

19. A kit of parts having components that are operatively adapted to be assembled together to form a display cabinet according to claim 11.

* * * * *